US010230170B1

(12) United States Patent
Boulais et al.

(10) Patent No.: US 10,230,170 B1
(45) Date of Patent: Mar. 12, 2019

(54) BROADBAND METAL LENS ANTENNA

(71) Applicants: Kevin A. Boulais, La Plata, MD (US); Walter D. Sessions, Marietta, GA (US); Reniery Cevallos, La Plata, MD (US); Sarah C. Weston, King George, VA (US); Lucas R. Hale, King George, VA (US)

(72) Inventors: Kevin A. Boulais, La Plata, MD (US); Walter D. Sessions, Marietta, GA (US); Reniery Cevallos, La Plata, MD (US); Sarah C. Weston, King George, VA (US); Lucas R. Hale, King George, VA (US)

(73) Assignee: The United States of America as represented by the Secretary of the Navy., Washington, DC (US)

( * ) Notice: Subject to any disclaimer, the term of this patent is extended or adjusted under 35 U.S.C. 154(b) by 44 days.

(21) Appl. No.: 15/644,856

(22) Filed: Jul. 10, 2017

(51) Int. Cl.
*H01Q 19/08* (2006.01)
*H01Q 13/02* (2006.01)

(52) U.S. Cl.
CPC ..... *H01Q 19/08* (2013.01); *H01Q 13/02* (2013.01)

(58) Field of Classification Search
CPC ..... H01Q 19/08; H01Q 13/02
See application file for complete search history.

(56) References Cited

U.S. PATENT DOCUMENTS 9,095,043 B2 7/2015 Boulais et al.

OTHER PUBLICATIONS

W. E. Kock, "Metal-Lens Antennas", Proc. IRE Waves and Electrons, 34, 11(1946). http://www.qsl.net/nlbwt/chap3.pdf.
Paul Wade: "Metal-Flate Lens Antennas", (1998) http://www.qsl.net/nlbwt/chap3.pdf.

*Primary Examiner* — Graham Smith
(74) *Attorney, Agent, or Firm* — Gerhard W. Thielman, Esq.

(57) ABSTRACT

A metal lens is provided for length compacting a horn antenna across a frequency bandwidth. The metal lens includes a feed guide segment having an input cross-section, an intermediate segment, and an exit segment. The feed guide segment receives a signal from the horn antenna along a carry direction; an intermediate segment that expands from the input cross-section laterally to the carry direction. The intermediate segment incorporates an intermediate split vane perpendicular to the carry direction to divide the signal along the carry direction. The exit segment incorporates a plurality of terminating split vanes lateral to the carry direction for transmitting the output signals.

5 Claims, 8 Drawing Sheets

700

BROADBAND METAL LENS ANTENNA

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to metal lenses for increasing bandwidth while reducing length in a horn antenna.

The metal lens antenna was described by W. E. Kock in "Metal Lens Antennas," *Proceedings of the I.R.E. and Waves and Electrons*, November 1946 (http://www.qsl.net/n1bwt/chap3.pdf). The metal lens utilized a series of parallel plate waveguides that were shaped on the front or rear to give a concave or convex appearance. As a ray of electromagnetic radiation traverses the parallel plates at different points, the different phase velocity of the wave within the plates would cause a beam focusing or expanding effect. Such a metal lens is compared to a typical lens fabricated of dielectric materials.

The metal lens suffers from small bandwidth caused by several phenomena. The first is due to chromatic aberrations, and Kock described a stepped lens approach to help correct this error. The second is due to impedance match at the input of the lens. Kock described a technique to tilt the lens from the horn axis to help minimize the reflected energy back into the horn's input. However, this method can distort the phase of the wave through the lens and has limiting effect.

SUMMARY

Conventional metal lenses for horn antennas yield disadvantages addressed by various exemplary embodiments of the present invention. In particular, exemplary embodiments provide a metal lens for length compacting a horn antenna while maintaining antenna gain across a frequency bandwidth. The metal lens includes a feed guide segment having an input cross-section, an intermediate segment, and an exit segment. The feed guide segment receives a signal from the horn antenna along a carry direction; an intermediate segment that expands from the input cross-section laterally to the carry direction. The intermediate segment incorporates an intermediate split vane perpendicular to the carry direction to divide the signal along said carry direction. The exit segment incorporates a plurality of terminating split vanes lateral to the carry direction.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
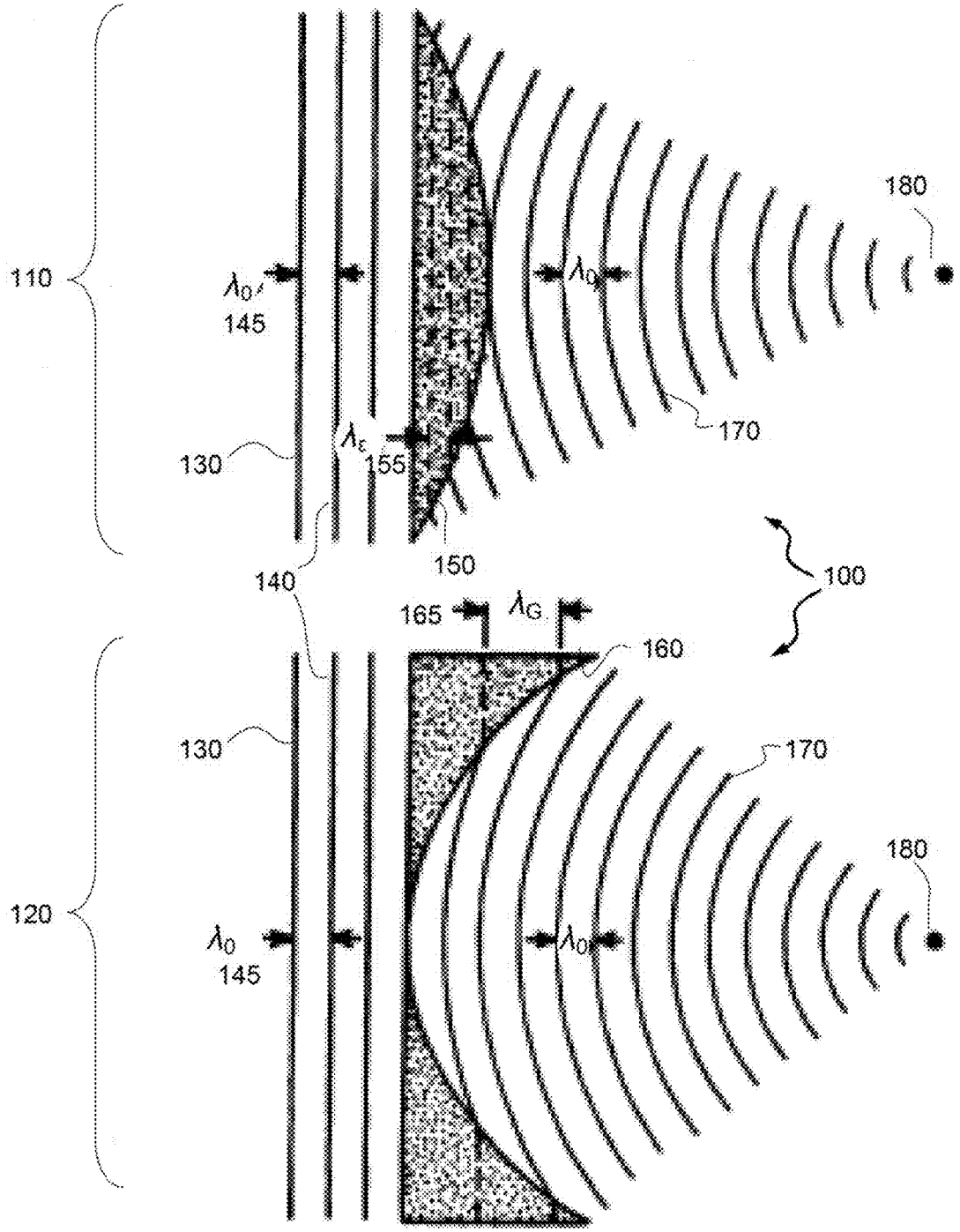
FIG. 1 Related Art
FIG. 1 is an elevation diagram view of a conventional dielectric and metal plate lenses.

FIG. 1 shows cross-section elevation (i.e., side) views 100 of conventional configurations for dielectric lens 110 and a conventional metal plate lens 120. An electromagnetic source 130 emits parallel energy waves 140 at free-space wavelength $\lambda_0$ 145. These waves 140 strike a convex dielectric 150 with a dielectric wavelength $\lambda_s$ 155, or alternatively strike a concave metal lens 160 with a guide wavelength $\lambda_G$ 165. The dielectric and guide wavelengths are respectively shorter and longer than the free-space wavelength $\lambda_0$ 145. Upon passing through the dielectric 150 or the metal lens 160, the exit waves 170 focus at the free-space wavelength $\lambda_0$ 145 to a focal point 180.

The phase velocity in free space is given by the speed of light, C and that in the parallel plate waveguide within free space is provided by eqn. (1):

$$v = \frac{C}{\sqrt{1 - \left(\frac{\lambda_0}{2a}\right)^2}} \tag{1}$$

where a is the plate separation distance. As described by Kock, this phase velocity translates to an effective index of refraction given by:

$$n = \sqrt{1 - \left(\frac{\lambda_0}{2a}\right)^2} \tag{2}$$

Because the index of refraction is less than unity, a concave shape as depicted in view 100 has the same effect as a convex dielectric lens with an index greater than unity. The value of plate separation distance a can be used to help shape the beam, but typically the face of the lens is used as shown in configuration 120. Many advantages of the metal lens antenna were presented in Kock's paper with 40-wavelength apertures.

Figure 2:
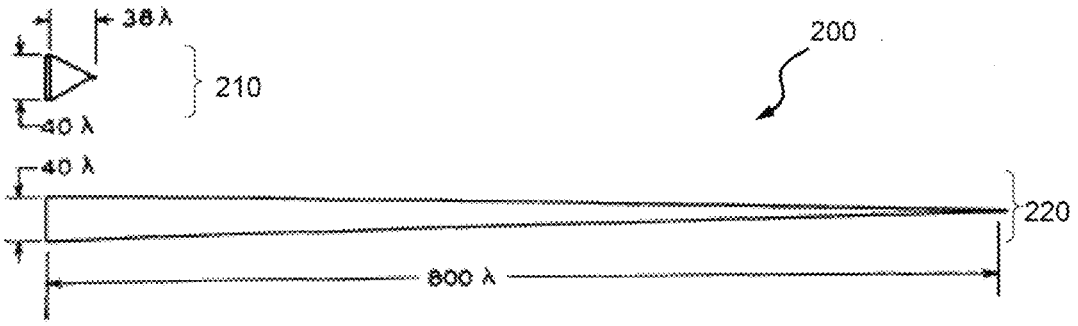
FIG. 2 Related Art
FIG. 2 is plan diagram view of a conventional antenna with and without a metal lens.

FIG. 2 shows a plan (i.e., top) view 200 comparing a horn antenna with a terminating metal lens 210 at the aperture and a high gain horn antenna 220 not so equipped. Both antennae 210 and 220 have the same antenna gain and similar performance. However, the antenna with the metal lens 210 is significantly shorter (by two orders of magnitude) than the antenna 220 without the lens, thus presenting one advantage.

The metal lens includes a feed guide segment having an input cross-section, an intermediate segment, and an exit segment. The feed guide segment receives a signal from the horn antenna along a carry direction; an intermediate segment that expands from the input cross-section laterally to the carry direction. The intermediate segment incorporates an intermediate split vane perpendicular to the carry direction to divide the signal along the carry direction. The exit segment incorporates a plurality of terminating split vanes lateral to the carry direction to broadcast output signals.

Figure 3:
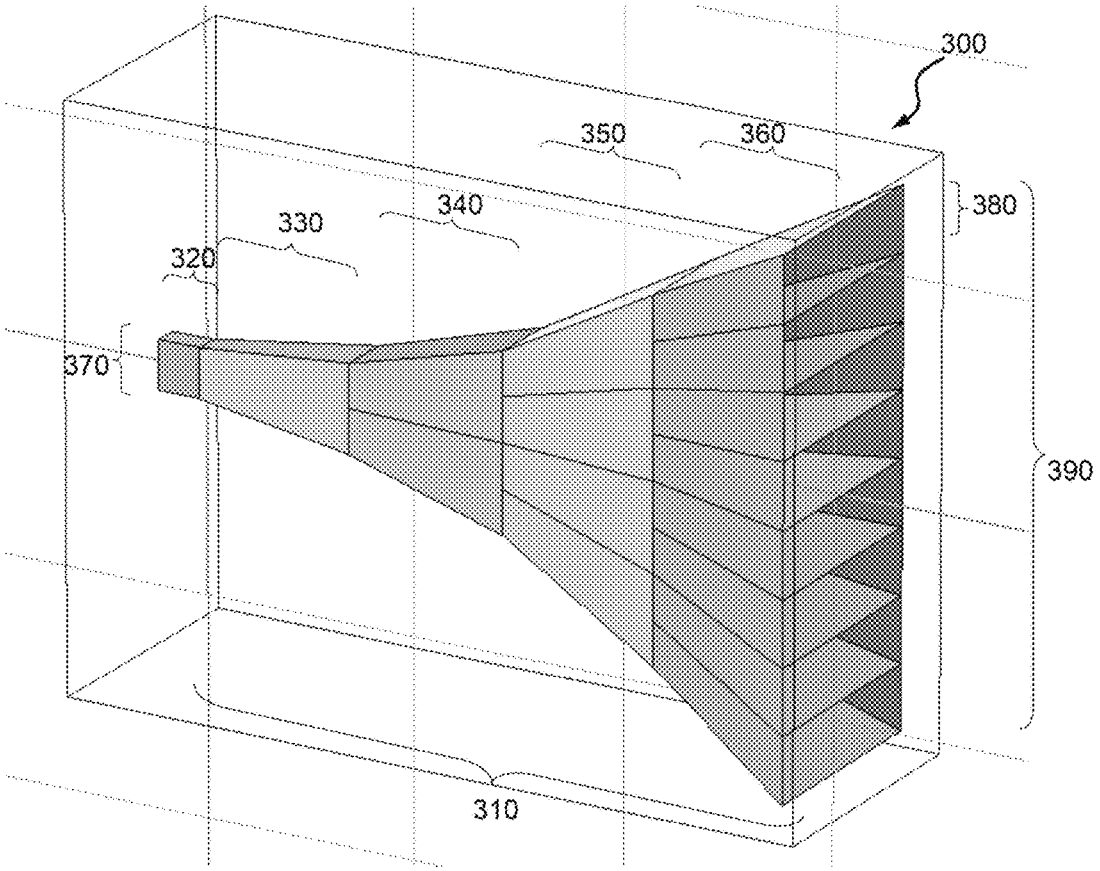
FIG. 3 is an isometric view of an exemplary horn antenna.

FIG. 3 shows an isometric assembly view 300 of an exemplary segmented multi-vane metal lens 310 composed of expanding sections in at least one direction defined by boundary walls. An entrance feed guide stage 320 receives input waveforms that proceed successively to intermediate stages 330, 340 and 350 with subdivided expanding apertures separated by baffles (e.g., vanes) until reaching the muzzle exit stage 360. Alternatively, the entrance stage 320 can terminate the input waveforms. The entrance stage 320 receives the waveforms through a feed-guide mouth 370. Vanes compartmentalize the exit stage 360 into aperture segments 380 that form the subdivided exit breach 390. The number and geometry of the intermediate stages shown by this example are provided for explanatory purposes and are not limiting.

Figure 4A:
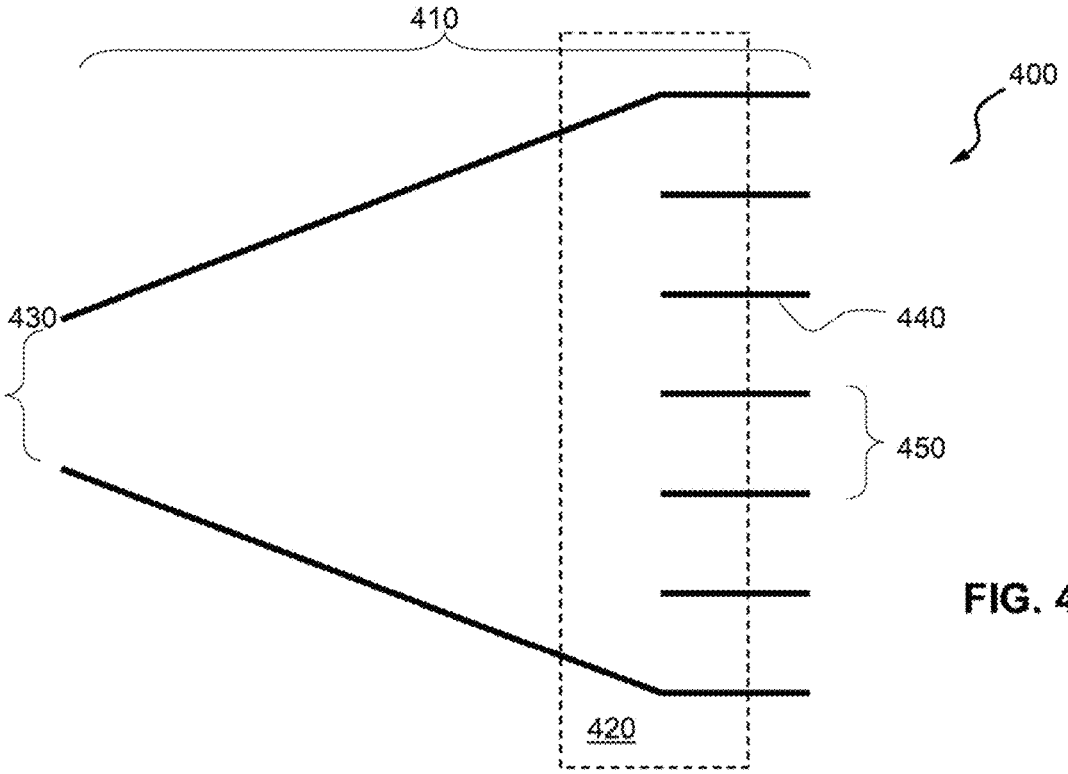
FIGS. 4A and 4B are plan views of a model for the horn antenna.
Figure 4B:
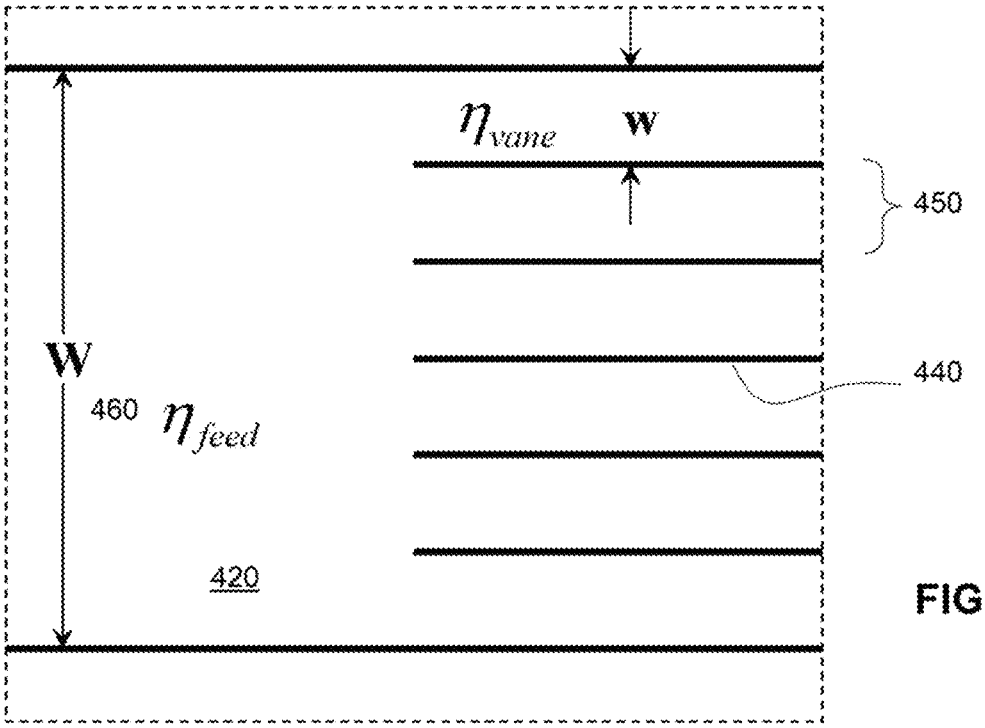

FIG. 4A shows a two-dimensional cross-section view 400 of a model 410 for a feed horn with a metal lens focusing element. FIG. 4B shows a cross-section elevation detail view 420 of a transition sub-section for the model 410 to determine an impedance match. The mouth 370 can be modeled as an entrance 430 for the input feed. A series of parallel vanes 440 having width w (in meters) provide channels 450 that form the breach 390 having width W (in meters). Similarly, for a transmitting antenna, the input of separation of each vane would remain the same for impedance match purposes. Downstream however, the vane can be pivoted so that the width w changes as shown in view 300. This effectively changes the phase velocity downstream and within each vane structure and enables increasing antenna gain, as opposed to shaping the leading edge. In other words, the outer vane structures can carry a faster phase velocity than the inner structures, thereby increasing gain.

Figure 5A:
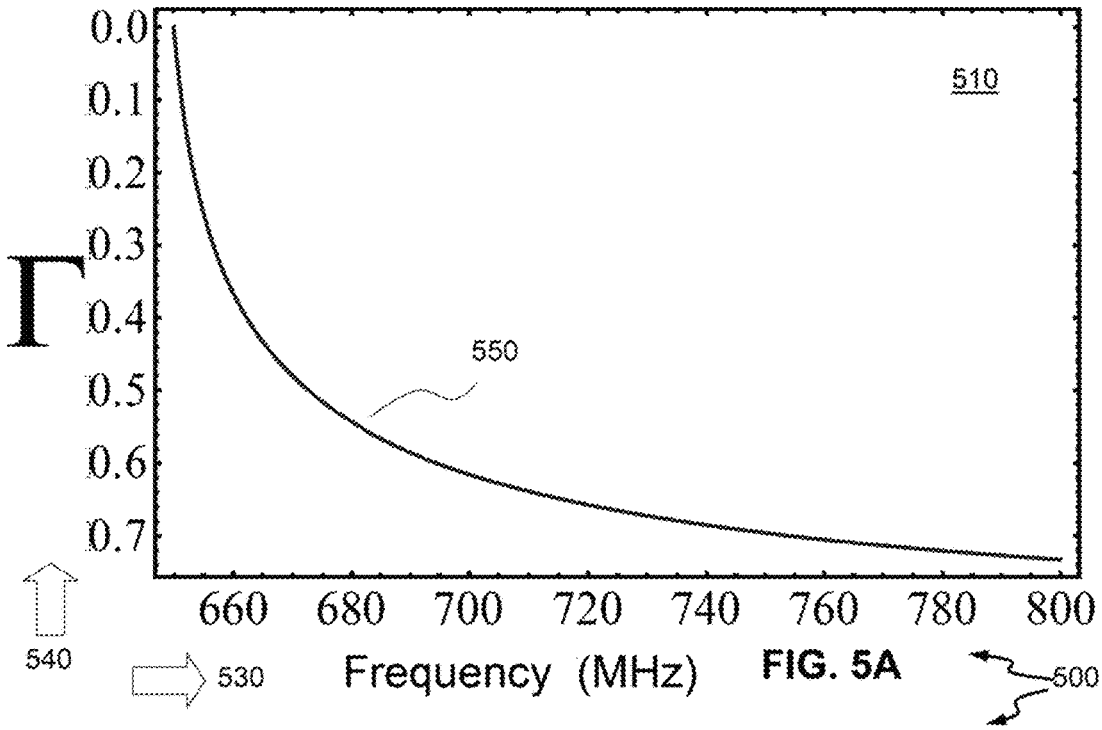
FIGS. 5A and 5B are graphical views of responses to impedance matching without vane splitting.
Figure 5B:
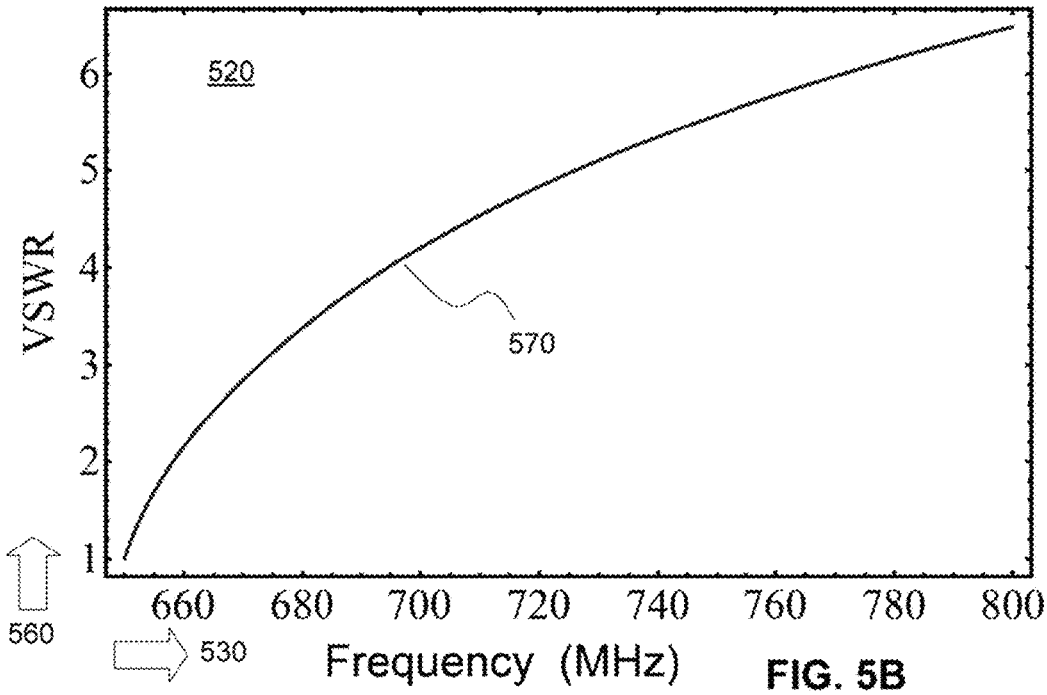

FIGS. 5A and 5B show graphical views 500 of impedance match response to frequency as respective plots 510 and 520 for a transverse electromagnetic (TEM) mode used for simplified explanation. FIG. 5A provides the reflection coefficient plot 510 having frequency (MHz) 530 as the abscissa and reflection coefficient Γ 540 as the ordinate. The response 550 perfectly matches at 650 MHz with zero reflection coefficient, while decreasing exponentially with increasing frequency between 650 MHz and 800 MHz. FIG. 5B provides the voltage standing wave ratio (VSWR) plot 520 having frequency (MHz) 530 as the abscissa and VSWR 560 as the ordinate. The VSWR response 570 matches perfectly (unity) at 550 MHz and increases gradually. The response at 800 MHz for this case without the vanes is extraordinarily large and thus unusable. For example, the VSWR is over 6.4 at 800 MHz, indicating that most electromagnetic energy reflects back from the aperture in a transmitting case.

Figure 6:
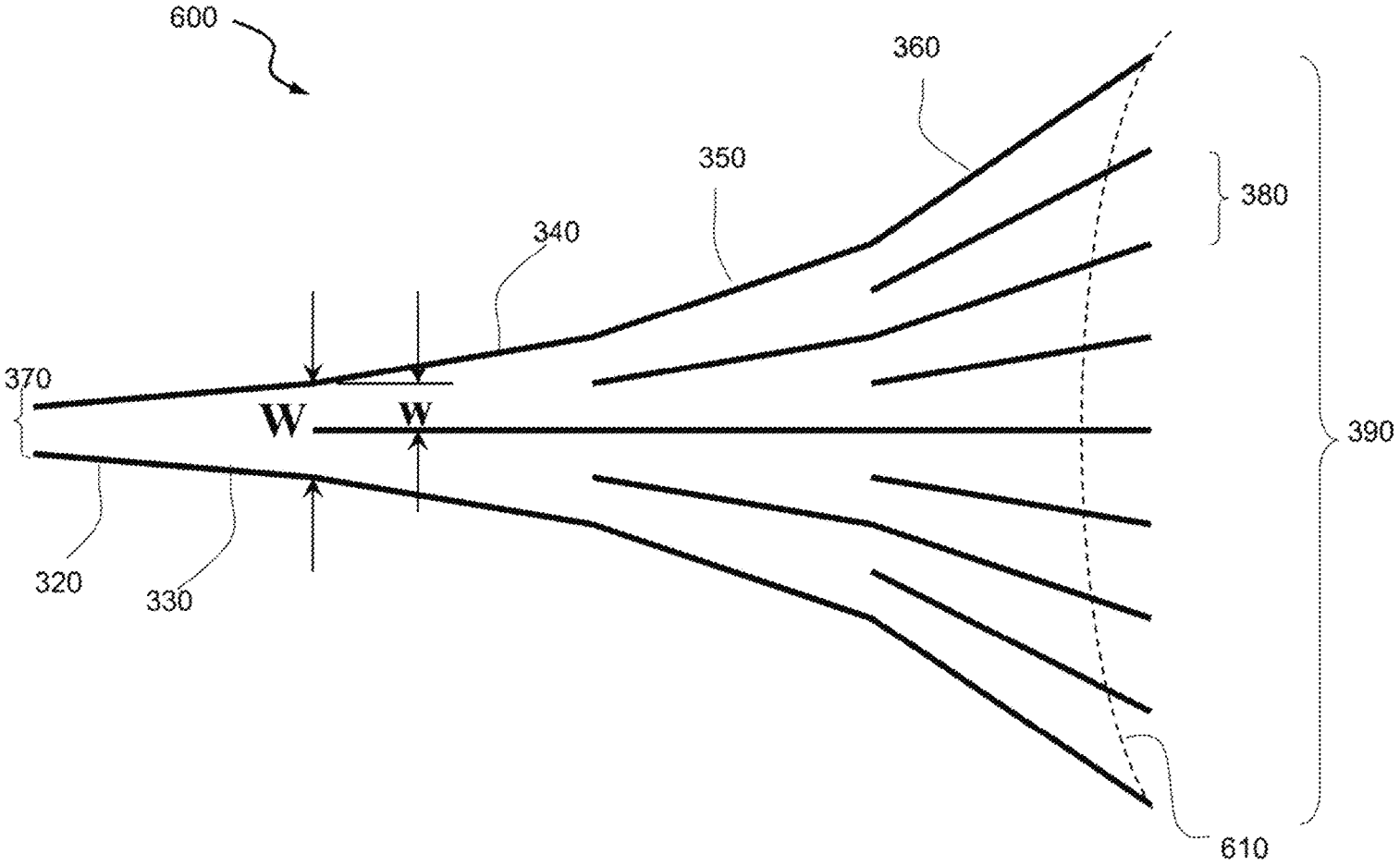
FIG. 6 is a cross-section elevation view of the horn antenna.

FIG. 6 shows a cross-section elevation view 600 of the exemplary metal lens 310. The stages subdivide the channel width inputs w (in a transmitting case) by half subdivisions. One center vane is disposed in intermediate stage 340. Two flanking vanes are disposed in intermediate stage 350. Four flanking vanes are interspersed in exit stage 360 to produce the aperture segments 380. Further, a dash curve 610 illustrates how the aperture could be shaped (i.e., truncated) to modify the lensing. Such shaping enables modification of the antenna gain. The aperture could also be shaped in the vertical direction.

Figure 7A:
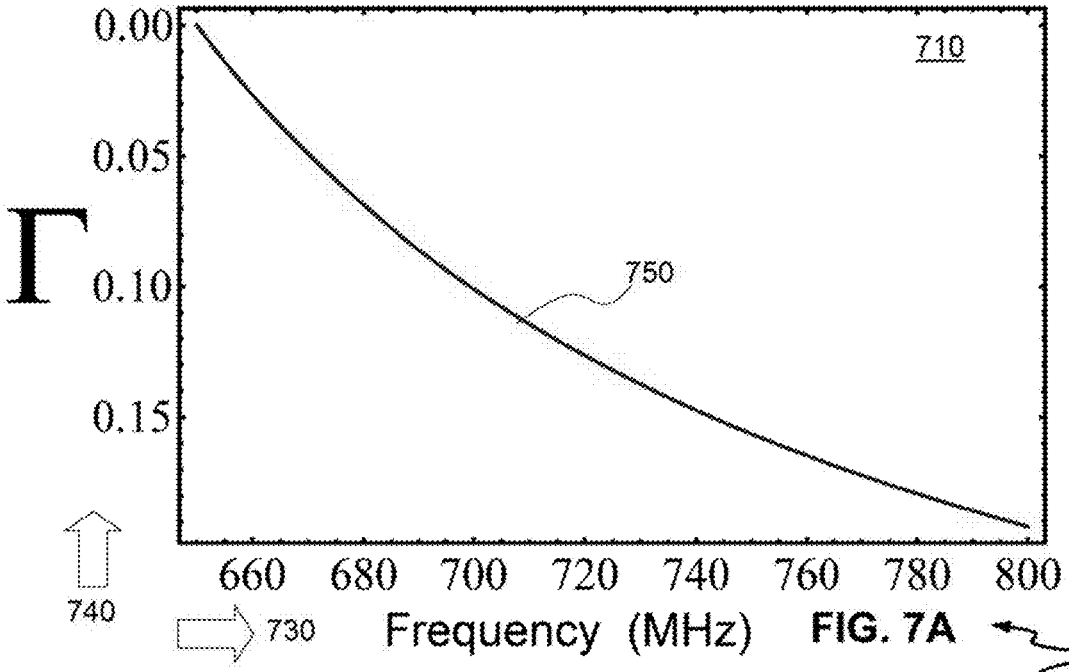
FIGS. 7A and 7*b* are graphical views of responses to impedance matching with vane splitting.
Figure 7B:
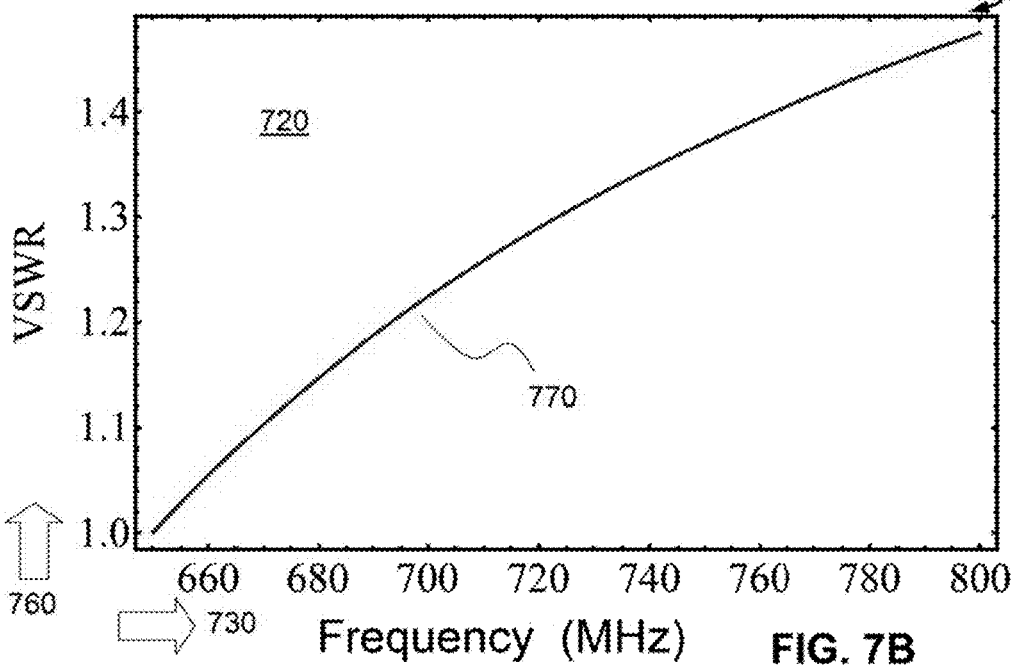

FIGS. 7A and 7B show graphical views 700 of vane split response to frequency as respective plots 710 and 720. FIG. 7A provides the reflection coefficient plot 710 having frequency (MHz) 730 as the abscissa and reflection coefficient Γ 740 as the ordinate. The reflection coefficient response 750 decreases exponentially, but at a much diminished rate as compared to view 510, with increasing frequency between 650 MHz and 800 MHz. FIG. 78 provides the VSWR plot 720 having frequency (MHz) 730 as the abscissa and VSWR 760 as the ordinate. The VSWR response 770 increases gradually from perfect unity at a frequency of 550 MHz, and increases at a much reduced rate compared to view 520. Views 700 show the exemplary embodiments' primary advantage as providing considerably more energy being emitted from (for transmitting) or collected by (for receiving) the aperture.

Figure 8:
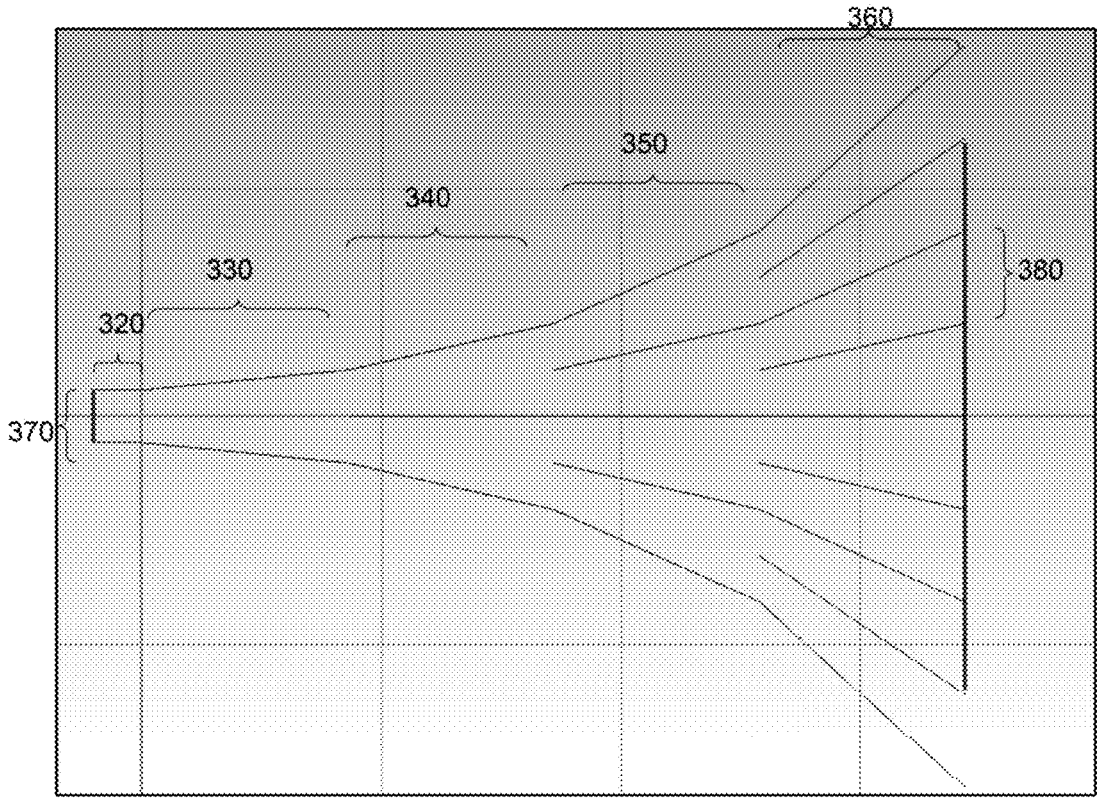
FIG. 8 is a cross-section plan view of antenna simulation.

FIG. 8 shows a cross-section elevation view 800 of the geometry incorporated to simulate a wideband metal lens antenna, similar to view 600. The values used are: length=3.86 m, height=0.146 m, input width=0.146 m and output width=4.13 m. Also, w=0.258 m, W=0.561 m and N=2 for each split.

Figure 9:
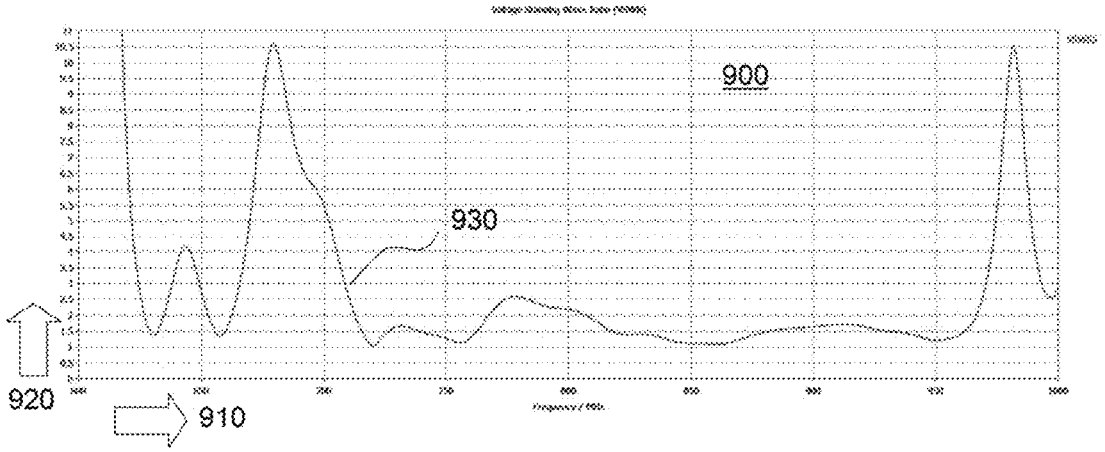
FIG. 9 is a graphical view of voltage standing wave ratio simulation response.

FIG. 9 shows a graphical view 900 of simulated VSWR for the broadband metal lens antenna geometry from view 800. Frequency 910 in megahertz (MHz) constitutes the abscissa while VSWR 920 represents the ordinate. The line 930 shows that the VSWR remains below 2.5 (a common requirement for many microwave devices) for a wide bandwidth of frequencies from approximately 720 MHz through 970 MHz, presenting a usable bandwidth of nearly 30%. With further optimization, the bandwidth could be further increased by removing the peak at approximately 675 MHz, which occurs due to a 180° phase shift at one of the vane inputs.

Figure 10:
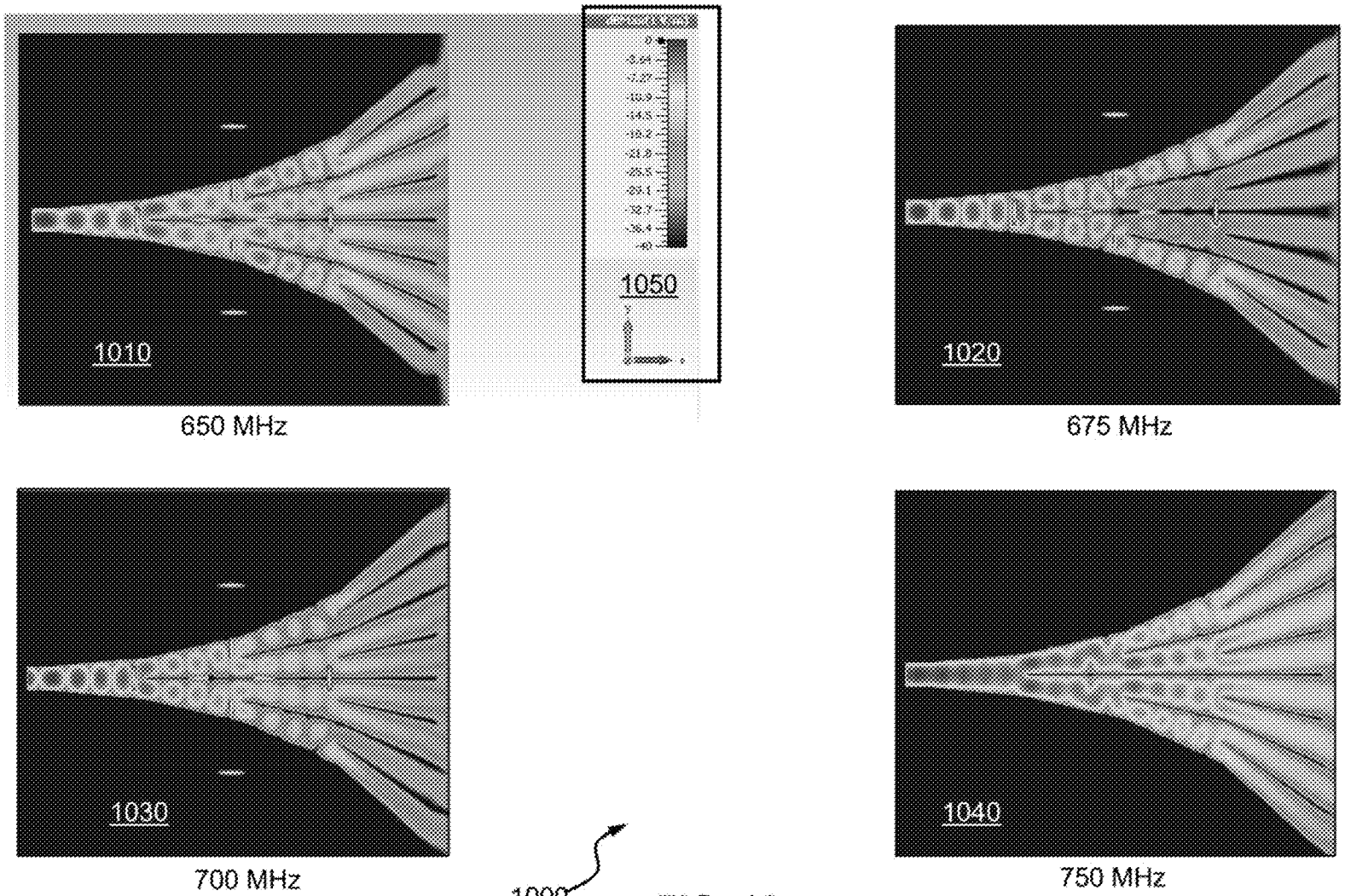
FIG. 10 is a contour set plan view of electric field response within the horn antenna.

FIG. 10 shows a contour set view 1000 featuring the electric field within the metal lens antenna by numerical modeling for the wideband metal lens geometry from view 700. The view 1000 constitutes four quad plots 1010 at 650 MHz, 1020 at 675 MHz, 1030 at 700 MHz and 1040 at 750 MHz. A legend 1050 shows graduated electric field amplitudes with a range between a minimum background of −40 dB to a maximum of 0 dB. The plots show how the electric field is divided from the mouth 370 and approaching background values by the exit 390. At frequency of 675 MHz, the electric field at the input of the second vane has a 180° phase shift, which corresponds to the peak discussed for view 900. The vanes can be further optimized to eliminate that peak for further enhanced bandwidth.

Various exemplary embodiments provide a broadband metal lens antenna. A conventional metal lens antenna can be used to focus an electromagnetic beam using shaped parallel plate waveguides. As a "lens" disposed at the end of a horn antenna, significant antenna gain can be availed with dramatically shorter antenna lengths than otherwise possible. The drawback of the conventional metal lens antenna is its single frequency nature. Exemplary embodiments describe a process to overcome the single frequency restriction, thereby enabling an exemplary metal lens 310 to operate over a significant bandwidth.

Exemplary embodiments described herein provide improved impedance match for the lens to the multi-vane metal lens 310, as illustrated by views 300, 600 and 800. The impedance mismatch between the feed guide 370, such as that presented by the section of horn immediately prior to the metal lens, and the input of the multi-vane metal lens as shown in view 400.

The impedance of the feed guide 370 can be matched to that of the multi-vane metal lens 310 represented as parallel loads. In the simplified model of assuming a TEM wave in the configuration of view 400, the impedance of each parallel plate guide 440 is:

$$\eta = \frac{\eta_0}{n} = \frac{n_0}{\sqrt{1-\left(\frac{\lambda}{2a}\right)^2}} \tag{3}$$

where $\eta_0$ is the impedance of free space (377Ω), λ is the wavelength of interest and a is the separation distance of the plates 440.

One then solves two equations:

$$\eta_{feed} = \frac{\eta_{vane}}{N} \tag{4}$$

$$\text{and } W = Nw \tag{5}$$

where N is the number of multi-vane guides in the metal lens structure, W is the width (separation) of the feed guide, and w is the width between vanes.

An exact number of vanes obtains an ideal impedance match at only one wavelength, and because N is an integer, W can be one specific number. Preferably, the match occurs at the longest wavelength, or else the match will become unmanageable. The solution of eqns. (4) and (5) are shown in plots 510 and 520 for N=1, W=2.549 m, and w=0.232 m. Clearly the impedance match is ideal at the longest wavelength (indicated by zero reflection coefficient and VSWR=1), but quickly becomes significant at higher frequencies (i.e., shorter wavelengths). The VSWR at the highest frequency is greater than six, which is generally unacceptable.

The exemplary embodiments for improving the impedance match over a wide bandwidth can now be described. Using metal lens type vane structures within a metal lens 310, each vane can be divided into two parts sequentially—in a binomial fashion. This is shown in view 600, where each vane 440 is assumed from straight line segments. The straight line parallel segments 440 facilitate fabrication more readily, but curved profiles can also be incorporated. Plots 710 and 720 respectively provide the reflection coefficient and VSWR for each split between sections. To arrive at a perfect impedance match at the longest wavelength for N=2, one can use W=0.516 m and w=0.258 m.

View 600 reveals binomial division used to improve impedance match over broad bandwidth. The "cut for focus" section curve 610 implies that curvature can be applied to improve antenna performance as typical of metal lens type antennae. Such curvature can be used in the orthogonal direction as well. View 700 reveals effects of the binomial configuration, with plot 710 for reflection coefficient and plot 720 for VSWR. The impedance match is perfect for the longest wavelength, and is significantly improved at shorter wavelengths using the binomial method (compare with plots 510 and 520). Simulated results of exemplary embodiments are mentioned herein. The geometry of the simulated antenna is presented in view 800, analogous to view 600. The simulated VSWR is displayed in view 900.

View 1000 shows a profile of the electric field internal to the antenna at four different frequencies. The face of the horn at exit 390, where the electromagnetic radiation exits (or enters upon receiving), can now be shaped for improved focusing and beam shaping as is characteristic of the metal lens 310, but with broadband performance.

The commercial potential exists because these exemplary embodiments provide for a dramatically shortened horn antenna that maintains a broadband nature and high gain. Horns are one of the most common type of antennae. Although cost would increase somewhat over a standard gain horn, its size can be dramatically decreased while maintaining performance. The exemplary horn antenna improves on the metal lens antenna described by Winston Kock so as to perform in broadband. Such an antenna has improved performance with a significantly smaller size than standard gain horn antennae.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A metal lens for length compacting a horn antenna while maintaining antenna gain across a frequency bandwidth, said metal lens comprising:

a feed guide segment having an input cross-section to receive a signal along a carry direction;

an intermediate segment that expands from said input cross-section laterally to said carry direction, said intermediate segment incorporating an mezzanine split vane parallel to said carry direction to divide said signal along said carry direction; and an exit segment that incorporates a plurality of terminating split vanes lateral to said carry direction.

2. The metal lens according to claim 1, wherein said intermediate segment comprises a plurality of intermediate segments.

3. The metal lens according to claim 1, wherein said intermediate segment are straight.

4. The metal lens according to claim 1, wherein said intermediate segment are curved.

5. The metal lens according to claim 1, wherein said carry direction includes boundary walls with said mezzanine split vane therebetween.

* * * * *